United States Patent [19]

Watanabe et al.

[11] Patent Number: 4,838,740

[45] Date of Patent: Jun. 13, 1989

[54] VARIABLE DISPLACEMENT VANE COMPRESSOR

[75] Inventors: Yasushi Watanabe; Masahiro Kawaguchi; Shinichi Suzuki; Tatsuya Nakai, all of Kariya, Japan

[73] Assignee: Kabushiki Kaisha Toyoda Jidoshokki Seisakusho, Aichi, Japan

[21] Appl. No.: 221,717

[22] Filed: Jul. 20, 1988

[51] Int. Cl.[4] ..... F04B 49/02; F04C 29/08

[52] U.S. Cl. ..... 417/295; 417/310

[58] Field of Search ..... 417/295, 310

[56] References Cited

U.S. PATENT DOCUMENTS 4,726,740 2/1988 Suzuki et al. ..... 417/295

4,744,732 5/1988 Nakajiima et al. ..... 417/295

*Primary Examiner*—William L. Freeh

*Attorney, Agent, or Firm*—Burgess, Ryan & Wayne

[57] ABSTRACT

A variable displacement vane compressor including a rotor rotatably supported between a pair of side plates secured to a cylinder, vanes movably supported in the rotor to define variable compression chambers in the cylinder, a reciprocally rotatable displacement control plate located between the rotor and one of the side plates for controlling the largest displacement of the compression chambers when closed, a spool chamber provided in one side plate and opposed to the displacement control plate, a spool which reciprocates in the spool chamber to define a first pressure chamber in which a refrigerant having a discharge pressure is introduced and a second pressure chamber in which an oil having the discharge pressure is introduced through a control valve unit in response to the suction pressure, the spool and the displacement control plate being interconnected by a connecting member and moving together, a seal ring between the displacement control plate and the one side plate, for isolating a high pressure area from a low pressure area, and feed passages for introducing the oil having the discharge pressure to the sealing ring. The one side plate has an elongated hole which permits movement of the connecting member extending therethrough, and the seal ring has a diameter smaller than that of an imaginary circle centered on the rotation axis of the rotor and circumscribing the elongated hole. The seal ring is eccentric to the rotation axis and includes the elongated hole in the seal ring.

9 Claims, 5 Drawing Sheets

VARIABLE DISPLACEMENT VANE COMPRESSOR

BACKGROUND OF THE INVENTION (1) Field of the Invention

The present invention relates to a variable displacement vane compressor including a rotor having a plurality of vanes and rotatably supported between a pair of side plates secured to opposite ends of a cylinder assembly in a housing so that a plurality of compression chambers are defined by the vanes in a space between the inner peripheral surface and the outer peripheral surface of the rotor, whereby the rotation of the rotor causes the compression chambers to be compressed and expanded and to be alternately connected to an inlet port and an outlet port to effect the suction, compression and discharge of refrigerant in the compression chambers, and a reciprocally rotatable displacement control plate located between the one of the side plates and the rotor to control the largest displacement of the compression chambers when closed.

(2) Description of the Related Art

Japanese Unexamined Patent Publication (Kokai) No. 61-76792 discloses a variable displacement vane compressor of the type mentioned above in which a spool chamber is provided at a position corresponding to the displacement control plate of one of the side plates to drive and control the displacement control plate. Accommodated in the spool chamber is a spool, which reciprocates in the spool chamber and which defines therein, a first pressure chamber into which the refrigerant having a pressure corresponding to the discharge pressure is introduced and a second pressure chamber into which an oil having a pressure corresponding to the discharge pressure is introduced, by a control valve mechanism actuated in response to the suction pressure. The spool is integrally connected to the displacement control plate by a pin and moves together therewith, to thereby drive and control the displacement control plate through the spool in accordance with the pressure balance between both pressure chambers. The control valve mechanism for controlling the introduction of the oil having a pressure corresponding to the discharge pressure into the second pressure chamber operates in response to the suction pressure, depending on the ambient temperature. Accordingly, the displacement control plate rotates about the axis of the rotor in accordance with the ambient temperature, to change the time at which, and the period for which, the fluid connection between the auxiliary inlet port formed in the displacement control plate and the compression chamber is established, so that a compression displacement depending on the ambient temperature can be obtained.

The time and the period of the connection of the auxiliary inlet port and the compression chamber are significant control parameters which ensure a desired compression displacement depending on the ambient temperature, but these control parameters are easily influenced by the efficiency of a sealing between the high pressure area and the low pressure area of the compressor. In particular, when refrigerant (gas) having a pressure corresponding to the discharge pressure is introduced into the first pressure chamber, a leakage of the high pressure gas may occur, to disturb the pressure balance between the first and second pressure chambers, so that the displacement control plate is moved in a direction in which the cooling power is reduced. This leakage of the high pressure gas from the first pressure chamber particularly depends on the efficiency of the sealing between the displacement control plate and the associated side plate, and thus a high sealing efficiency established between the high pressure area and the low pressure area is also required between the displacement control plate and the associated side plate. Nevertheless, it is very difficult to prevent a leakage of the high pressure gas by only the provision of a seal ring as used in most conventional compressors, and thus a reduced cooling efficiency depending on the ambient temperature occurs.

To solve the problem mentioned above, the assignee of the present application has proposed a vane compressor as shown in FIG. 6, in which an annular seal member 53 is provided between the displacement control plate 51 and the associated side plate 52 to isolate the high pressure area and the low pressure area, and the seal member 53 is connected to the oil feed passages 54 and 55 for introducing the oil having a pressure corresponding to the discharge pressure (Japanese Unexamined Patent Application No. 62-94867). In this arrangement, the seal member 53 ensures the isolation of the high pressure area from the low pressure area. The displacement control plate 51 is subject, on the front side thereof, (i.e., on the left side of FIG. 6), to the suction pressure $P_s$ which acts on the surface area $A_1$ located outside the seal member 53, and the discharge pressure $P_4$ which acts on the surface area $A_2$, respectively. On the other hand, the displacement control plate 51 is subject, on the rear side thereof (i.e., on the right side in FIG. 6), to the pressure represented by $(P_s+P_d)/2$ from the cylinder, so that the displacement control plate 51 is pressed against the cylinder under a pressure (force) F represented by the following equation.

$$\begin{aligned} F &= P_sA_1 + P_dA_2 - \{(P_s + P_d)/2\}A_3 \\ &= (A_1 - A_3/2)P_s + (A_2 - A_3/2)P_d \end{aligned}$$

Since the surface area $A_2$ is not equal to the surface area $(A_3/2)$, the pressure F is influenced by the discharge pressure $P_d$, and a large discharge pressure increases the frictional force between the displacement control plate 51 and the cylinder, resulting in difficulties arising in the operation of the displacement control plate 51.

The primary object of the present invention is to eliminate the above-mentioned drawbacks of the prior art by providing a variable displacement vane compressor including a housing having therein a cylinder secured thereto, a pair of side plates secured to axially opposite ends of the cylinder, a rotor rotatably supported between the side plates and having a plurality of vanes movably supported in the rotor and coming into contact with the inner peripheral surface of the cylinder to define a plurality of compression chambers between the inner peripheral surface of the cylinder and the outer peripheral surface of the rotor, the volumes of the compression chambers being changed in accordance with the rotation of the rotor. The cylinder is provided with refrigerant inlet ports and refrigerant outlet ports which can be selectively connected to the compression chambers, and a reciprocally rotatable displacement control plate between the rotor and one of the side plates for controlling the largest displacement of the compression chambers when closed.

The improvement according to the present invention comprises a spool chamber provided in one side plate and opposed to the displacement control plate, a spool which reciprocates in the spool chamber to define a first pressure chamber into which a refrigerant having a pressure corresponding to the discharge pressure of the compressor is introduced and a second pressure chamber into which an oil having a pressure corresponding to the discharge pressure is introduced through a control valve in response to a suction pressure of the compressor, the spool and the displacement control plate being interconnected by a connecting member and moving together, an annular sealing means arranged between the displacement control plate and the one side plate for isolating a high pressure area from a low pressure area of the compressor, and a feed passage for introducing the oil having a pressure corresponding to the discharge pressure into the sealing means, the one side plate being provided with an elongated hole which permits movement of the connecting member extending therethrough, the annulus of the annular sealing means having a diameter smaller than that of a imaginary circle centered on the axis of rotation of the rotor and circumscribing the elongated hole, the annulus of the annular sealing means being eccentric to the axis of rotation of the rotor so that the elongated hole is included in the annulus of the annular sealing portion.

With this arrangement, the sealing efficiency between the displacement control plate and the associated side plate, which has an influence on the largest displacement when the compression chambers are closed, is increased by the introduction of the oil having a pressure corresponding to the discharge pressure, so that a leakage of the refrigerant gas having a pressure corresponding to the discharge pressure from the first pressure chamber can be effectively prevented. In addition, the pressing force which forces the displacement control plate onto the cylinder can be reduced, and as a result, the pressures in both pressure chambers can be properly balanced, using the suction pressure depending on the ambient temperature, and the displacement control plate can be smoothly operated, and thus a precise control of the largest displacement at the closure of the compression chambers in accordance with the ambient temperature can be realized.

BRIEF DESCRIPTION OF THE DRAWINGS

The present invention will be described below in detail with reference to the accompanying drawings, in which.

DESCRIPTION OF THE PREFERRED EMBODIMENTS

Figure 1:
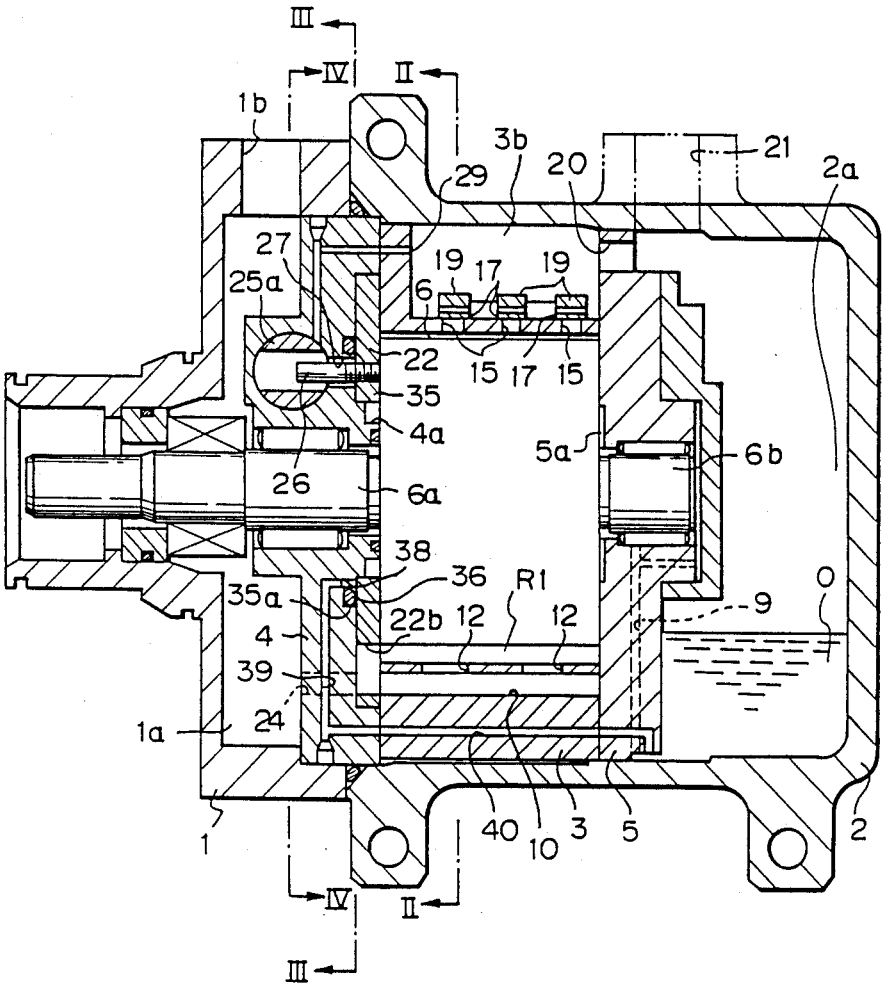
FIG. 1 is a longitudinal sectional view of a variable displacement vane compressor according to one aspect of the present invention.

FIGS. 1 to 5 show an embodiment of the present invention, wherein a cylinder 3 is accommodated in and secured to a housing including a front housing 1 and a rear housing 2 secured to the front housing 1. The cylinder 3 is provided, on the front and rear ends thereof, with a front side plate 4 and a rear side plate 5, secured to the respective ends. The cylinder 3 has an elliptical cylindrical chamber 71(FIG. 2) in which is housed a circular cylindrical rotor 6 having supporting shafts *6a* and *6b* integral with the axial opposite ends thereof, so that the rotor 6 is rotatably supported in the cylinder chamber 71 by the side plates 4 and 5, through the supporting shafts *6a* and *6b*. The rotor 6 is provided, on the outer periphery thereof, which a plurality of vane grooves 7 (four vane grooves 7 are provided in the illustrated embodiment), each having a uniform width and a predetermined depth. The vane grooves 7 extend substantially in the radial direction of the rotor 6 and are provided with vanes 8 able to slide substantially in the radial direction of the rotor in the respective vane grooves 7 while maintaining close contact with the opposite side plates 4 and 5. The bottoms of the vane grooves 7 are communicated with an oil separation chamber *2a* formed in the rear portion of the rear housing 2, through an annular passage *5a* (FIG. 1) formed on the rear side plate 5, a bearing portion of the supporting shaft *6b*, and a radial passage 9 formed in the rear side plate 5, so that the lubricating oil 0 held in the oil separation chamber *2a* is fed to the bottoms of the vane grooves 7.

Each vane 8 is pressed against the inner peripheral wall of the cylinder chamber 71 by the centrifugal force produced by the rotation of the rotor 6, and by the fluid pressure in the bottoms of the vane grooves 7 in communication with the oil separation chamber *2a*, to divide the cylinder chamber 71 into a plurality of compression chambers $R_1$ and $R_2$. Note that an annular passage *4a* similar to the annular passage *5a* is formed on the front side plate 4 to correspond to the bottoms of the vane grooves 7, so that the lubricating oil 0 can be fed to the annular passage *4a* through the vane grooves 7.

Figure 2:
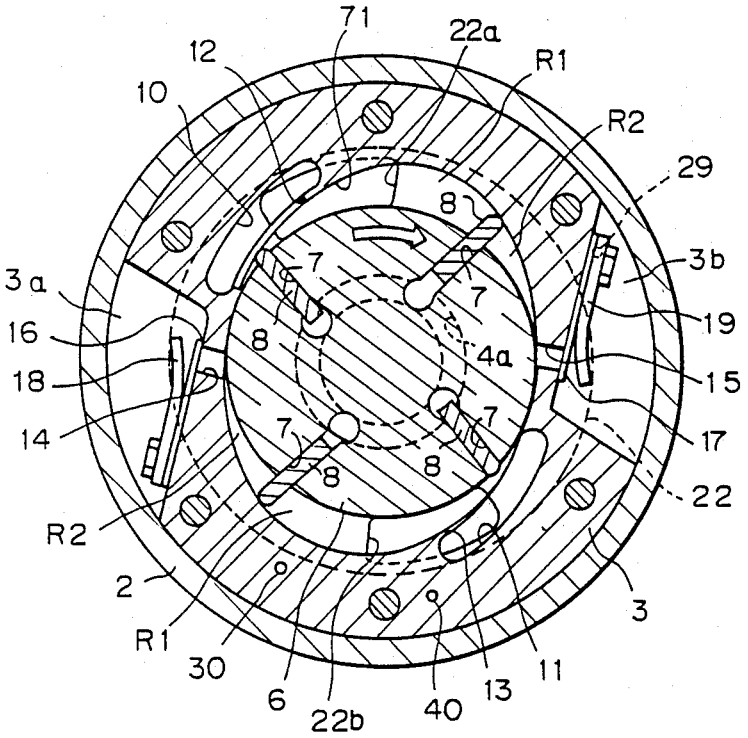
FIG. 2 is a sectional view taken along the line II—II in FIG. 1.

As can be seen from FIGS. 1 and 2, the cylinder 3 is provided with a pair of axial inlet passages 10 and 11 axially extending therethrough and connected to inlet ports (suction ports) 12 and 13 opening into the cylinder chamber 71. The inlet ports 12 and 13 are located at an angular phase of 180°. A pair of outlet chambers (discharge chambers) *3a* and *3b* are formed in the cylinder 3 in the vicinity of the inlet passages 10 and 11 in the circumferential direction of the cylinder 3. These outlet chambers *3a* and *3b* are connected to a pair of outlet ports (discharge ports) 14 and 15 which open into the cylinder chamber 71 and are located at an angular phase of 180°. Provided in the outlet chambers *3a* and *3b* are normally closed discharge valves 16 and 17 formed by elastic plates and selectively opening and closing the respective outlet ports 14 and 15. The angular movement of the discharge valves 16 and 17 toward the open position is restricted by keep plates 18 and 19 secured to the cylinder 3 together with the respective discharge valves 16 and 17. The discharge chambers *3a* and *3b* are connected to the oil separation chamber *2a* through connecting passages 20 (only one is shown in FIG. 1) formed in the rear side to an outlet 21 of the compressor.

Figure 4:
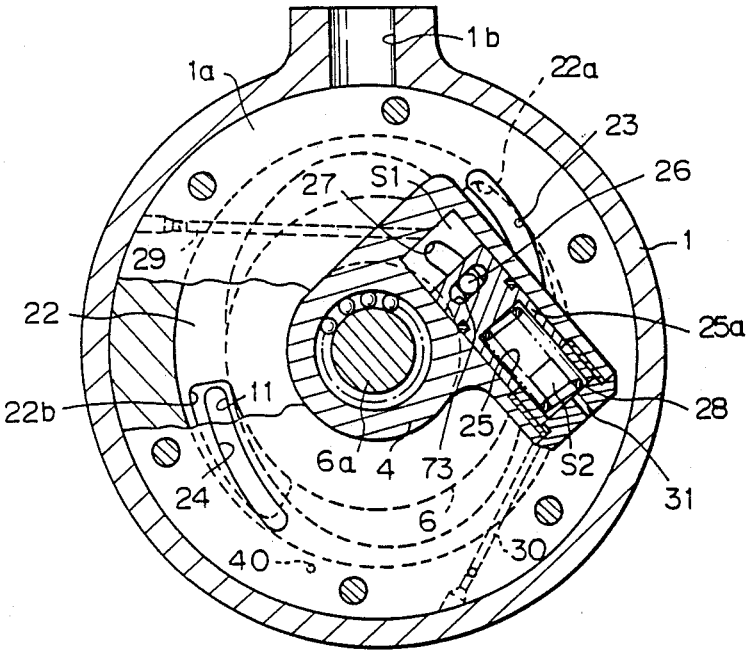
FIG. 4 is a sectional view taken along the line IV—IV in FIG. 1.

Provided between the rotor 6 and the front side plate 4 is a displacement control plate 22, in the form of a circular annulus, and rotatable about the supporting shaft 6a. The displacement control plate 22 has a pair of auxiliary inlet ports (suction ports ) 22a and 22b which are located at an angular phase of 180°. The auxiliary inlet ports 22a and 22b can be connected to both the inlet passages 10, 11 and to the cylinder chamber 71. The angular displacement of the displacement control plate 22 is restricted to a predetermined range within which it can be connected to both the inlet passages 10, 11 and the cylinder chamber 71. As shown in FIG. 4, the front side plate 4 is provided with a pair of introduction holes 23 and 24 corresponding to the respective inlet passages 10 and 11, so that the inlet chamber (suction chamber) 1a formed in the front housing land having an inlet 1b is connected to the inlet passages 10 and 11 and the cylinder chamber 71 through the auxiliary inlet ports 22a and 22b.

The front side plate 4 has a spool chamber 25 located in a position corresponding to the displacement control plate 22. This spool chamber 25 receives therein a spool 25a which defines a first pressure chamber $S_1$ and a second pressure chamber $S_2$, in the spool chamber 25, and which is capable of slidably reciprocating in the spool chamber in a substantially circumferential direction of the displacement control plate 22. The spool 25a has an elongated hole 73 into which a drive pin 26, serving as a connecting member which is screwed in the displacement control plate 22, is loosely fitted, and extends through to an elongated archwise hole 27 formed in the front side plate 4. The spool 25a is continuously biased by a compression spring 28 provided in the second pressure chamber $S_2$ toward the first pressure chamber S . The first pressure chamber S is connected to one outlet chamber 3b through a passage 29 formed in the cylinder 3 and the front side plate 4, as shown in FIGS. 1 and 4, and the second pressure chamber $S_2$ is connected, on one hand, to the reserved oil portion in the oil separation chamber 2a through a passage 30 formed in the cylinder 3, the front side plate 4, and the rear side plate 5, respectively, and on the other hand, to the inlet chamber 1a through a pressure reduction hole 31 formed in a cover 75 secured to the front side plate 4, to close the second pressure chamber $S_2$, as shown in FIGS. 1 and 5.

Figure 5:
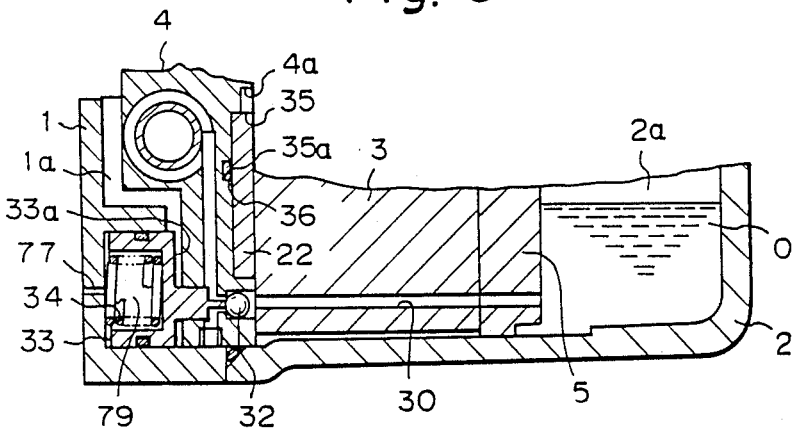
FIG. 5 is a partial sectional view showing a control valve mechanism and the surroundings thereof, according to one aspect of the present invention; and, FIG. 6 is a partially sectional side elevational view of a conventional vane compressor proposed by the assignee of the present application.
Figure 6:
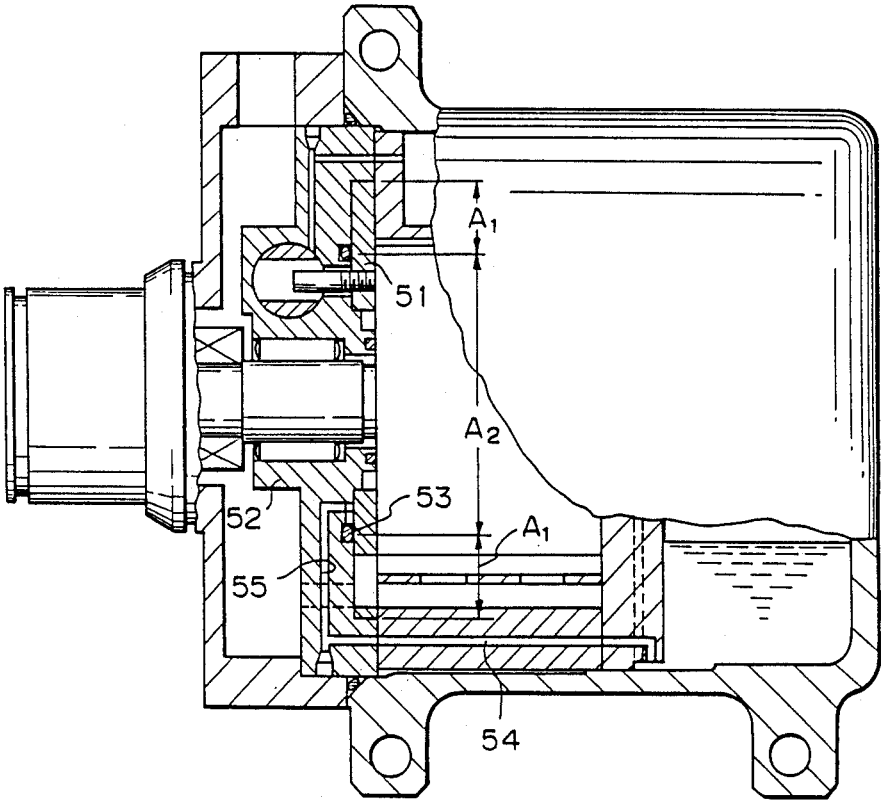
Fig. 6 (PRIOR ART)

As can be understood from FIG. 5, the passage 30 is provided with a non-return valve 32 which comes into contact with a piston 33 which projects at the front end thereof into the passage 30. The piston 33 is biased by a compression spring 34 provided between the piston 33 and the front housing 1, and has a pressure receiving surface 33a exposed in the suction chamber 1a. The non-return valve 32, the piston 33, and the compression spring 34 constitute a control valve mechanism. The piston 33 can be brought to an open position in which the passage 33 is not closed by the non-return valve (ball valve) 32, i.e., the passage 30 is open, by the piston 33 which is continuously biased by the spring force of the compression spring 34. The piston 33 always receives the atmospheric pressure on the side thereof opposed to the pressure receiving surface 33a, through an air opening 77 formed in the front housing 1. Namely, a space 79 formed on the side of the piston 33 opposed to the pressure receiving surface 33a is open to the atmosphere through the air opening 77. In FIG. 5, when the non-return valve 32 moves right, the passage 30 is opened.

On the other hand, the pressure (suction pressure) in the suction chamber 1a and the pressure (discharge pressure) in the oil separating chamber 2a is exerted on the piston 33 and on the non-return valve 32, respectively, in the direction in which the passage 30 is closed by the non-return valve 32 against the spring force and the atmospheric pressure mentioned above for opening the non-return valve 32. Namely, the non-return valve 32 can be moved left in FIG. 5 by the discharge pressure and the suction pressure which moves the piston left in FIG. 5, and as a result, the position of the non-return valve, i.e., opening and closing of the passage 30, can be controlled by the balance of the pressure for opening and closing the passage 30.

Figure 3:
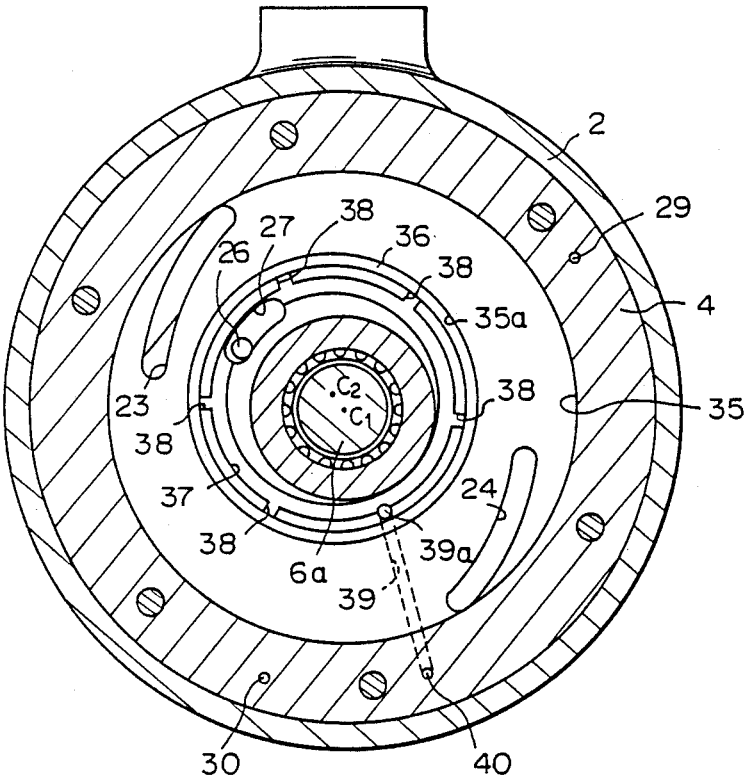
FIG. 3 is an enlarged sectional view taken along the line III—III in FIG. 1.

As can be seen in FIG. 3, the front side plate 4 has a circular receiving recess 35 thereon, in which the displacement control plate 22 is received, and an annular seal groove 35a is provided on the bottom of the receiving recess 35 to isolate the high pressure area from the low pressure area. A seal ring 36 is fitted in the seal groove 35a to form an annular seal portion. The seal groove 35a is in the form of a circular annulus having a diameter smaller than that of an imaginary circle centered on the axis of the rotation of the rotor 6 and circumscribing the elongated hole 27. The center of the circular annulus is eccentric to the axis of the rotation of the rotor 6 and includes the elongated hole 27. In the illustrated embodiment, the surface area of the displacement control plate located inside the seal ring 36 which corresponds to the area $A_2$ in FIG. 1, i.e., the high pressure area for pressing the displacement control plate 22 toward the cylinder 3, is half (i.e., substantially half) the surface area of the total pressure receiving surface of the displacement control plate 22 on the cylinder side. Inside the seal groove 35a is formed an annular intermediate passage 37 connected to the elongated hole 27, so that the intermediate passage 37 and the seal groove 35a are interconnected through a plurality of connecting passages 38. An outlet 39a of the feed passage 39 formed in the front side plate 4 opens into the intermediate passage 37, so that the intermediate passage 37 is connected to the reserved oil portion in the oil separation chamber 2a through feed passages 40 formed in the front side plate 4 and in the cylinder 3, and as a result, the lubricating oil 0 in the oil separation chamber 2a is fed to the seal groove 35a.

The vane compressor of the present invention operates as follows.

When the rotor 6 is rotated under a uniform pressure in the suction chamber 1a, and in the discharge chambers 3a and 3b, the spool 25a comes into contact with the inner end of the first pressure chamber $S_1$, and the non-return valve 32 opens the passage 30 at the commencement of the rotation of the rotor 6. Consequently, the auxiliary inlet ports 22a and 22b are deviated from the introduction holes 23 and 24 and the inlet passages 10 and 11 and partly overlap the introduction holes 23 and 24 and the inlet passages 10 and 11, respectively, as can be seen in FIG. 2. The refrigerant gas in the suction chamber la is introduced into the compression chambers $R_1$ defined by the vanes 8 and increasing in volume. Then, the volumes of the compression chambers $R_1$ are reduced, and for a certain period of time after the volume reduction stroke, the auxiliary inlet ports 22a and 22b are connected to the respective compression chambers $R_1$, so that substantially no compression of the refrigerant gas takes place in the compression chambers $R_1$. Namely, the largest volume (displacement) of the compression chambers $R_1$ when closed is controlled to a minimum limit by the displacement control plate 22, so that the compressor performs a small displacement of compression at the commencement (early stage) of the operation. This ensures a smooth rise of an engine load of an internal combustion engine of an automobile in which the present invention can be used for an air-conditioner of the automobile.

During the small compression displacement, the pressure balance between the sum of the suction pressure in the suction chamber la and the discharge pressure in the oil separation chamber 2*a*, and the sum of the spring force of the compression spring 34 and the atmospheric pressure, is inclined toward a closure of the passage 30 by the non-return valve 32, so that the feed of oil 0 through the passage 30 into the second pressure chamber $S_2$ is stopped when the passage 30 is completely closed. As a result, the pressure balance between the first pressure chamber $S_1$ connected to the discharge chamber 3*b* through the passage 29 and the second pressure chamber $S_2$ connected to the suction chamber 1*a* through the pressure reduction hole 31 causes the spool 25*a* to move toward the second pressure chamber $S_2$, so that the auxiliary inlet ports 22*a* and 22*b* substantially overlap the introduction holes 23, 24, and the inlet passages 10 and 11, respectively, as shown in FIG. 4. Accordingly, immediately after the compression chambers $R_1$ move from the volume increasing stroke to the volume decreasing stroke, the connection between the auxiliary inlet ports 22*a*, 22*b* and the associated compression chambers $R_1$ is broken, so that a compression of the refrigerant gas in the compression chambers $R_1$ occurs immediately. Namely, the largest volume (displacement) of the compression chambers $R_1$ when closed is controlled to a maximum limit, so that the compressor performs a large compression displacement.

During the large compression displacement when the ambient temperature approaches a desired value, the suction pressure falls below the predetermined set value, depending on the desired temperature, because of the decrease of the cooling load, so that the non-return valve 32 again opens the passage 30. Then, the oil 0 having a pressure corresponding to the discharge pressure is fed to the second pressure chamber $S_2$, where the oil pressure operates the spool 25*a* while being slightly reduced by the pressure reduction hole 31. As a result, the spool 25*a* moves toward the first pressure chamber $S_1$ and stops when the pressures between the first and second pressure chambers $S_1$ and $S_2$ are balanced. Namely, the displacement control plate 22 is rotated to a position in which the small compression displacement is carried out, so that when the ambient temperature approaches or reaches the desired value, the cooling power of the compressor is reduced accordingly.

The switching operation of the cooling power of the compressor in accordance with the ambient temperature can be performed by control of the pressure balance between the first and second pressure chambers $S_1$ and $S_2$. It should be appreciated that the refrigerant gas in the first pressure chamber $S_1$ having a high pressure corresponding to the discharge pressure tends to leak into the low pressure areas, such as the auxiliary inlet ports 22*a* and 2*b*, etc., through a gap between the displacement control plate 22 and the front side plate 4. The leakage of the refrigerant gas in the first pressure chamber $S_1$ would cause a pressure drop therein, so that the pressure balance between the first and second pressure chambers $S_1$ and $S_2$ would be inclined toward a further movement of the spool 25*a* toward the first pressure chamber $S_1$, beyond a correct position of the spool 25*a*. This would cause a further angular displacement of the displacement control plate 22 toward the small compression displacement, resulting in a decreased cooling efficiency insufficient to promote a cooling of the ambient atmosphere.

Nevertheless, according to the present invention, since the oil 0 having a pressure corresponding to the discharge pressure is fed to the seal portion having the annular groove 35*a* and the seal ring 36 inserted therein for isolating the high pressure area corresponding to the discharge pressure from the low pressure area corresponding to the suction pressure, through the feed passages 40, 39, the intermediate passage 37, and the connecting passage 38, the sealing efficiency of the sealing portion is sufficient to prevent a leakage of the refrigerant gas from the high pressure area to the low pressure area, and thus a prevention of the refrigerant having a high pressure corresponding to the discharge pressure in the first pressure chamber $S_1$.

On the other hand, the feed of the high pressure oil 0 to the annular sealing portion causes the discharge pressure $P_d$ and the suction pressure $P_s$ to be exerted on the surface portions $A_2$ and $A_1$ of the displacement control plate 22 located inside and outside the seal ring 36, respectively. Furthermore, the rear side of the displacement control plate 22 is subjected to the pressure represented by $(P_s+P_d)/2$, from the cylinder chamber 3, and as a result, the displacement control plate 22 is pressed toward the cylinder 3 by the difference in force between the front side and the rear side. Accordingly, if the high pressure surface area $A_2$ of the displacement control plate 22 inside the seal ring 36 is large, the frictional force between the displacement control plate 22 and the cylinder 3 when the discharge pressure $P_d$ also becomes high, resulting in failure in the smooth operation of the displacement control plate 22. To solve this problem, it is necessary to decrease the diameter of the annular sealing portion in order to decrease the high pressure surface area $A_2$. But, in view of the presence of the elongated hole 27, which permits movement of the drive pin 26 connecting the displacement control plate 22 and the spool 25*a*, it is difficult to reduce the diameter of the sealing portion, if the sealing portion is concentric to the axis of rotation of the rotor 6. In addition, it is necessary to increase the stroke of the drive pin 26 in order to locate the drive pin outside the sealing portion, resulting in a larger control mechanism. But, in the present invention, since the center $C_2$ (FIG. 3) of the seal groove 35*a* is eccentric to the axis $C_1$ of rotation of the rotor 6, it is possible to realize a small diameter sealing portion which includes therein the elongated hole 27. The results in a decrease of the force pressing the displacement control plate 22 toward the cylinder 3 and in a smooth operation of the displacement control plate 22. Accordingly, and due to the sufficient sealing effect of the sealing portion, as mentioned above, an interaction between the first and second pressure chambers $S_1$ and $S_2$, in response to the suction pressure depending on the ambient temperature can be carried out, so that the control of the largest displacement at the closure of the compression chambers can be precisely effected in accordance with the ambient temperature.

In the illustrated embodiment, the sealing portion having the seal groove 35*a* and the seal ring 36 fitted therein is formed such that the surface area $A_2$ of the displacement control plate 22 inside the sealing portion is half the surface area $A_3$ of the displacement control plate 22 which receives the pressure represented by $(P_s+P_d)/2$ from the rear side and which corresponds to the surface area of the elliptical cylinder chamber 71, and accordingly, the force F which presses the displacement control plate 22 against the cylinder 3 is given by the following equation, as mentioned before:

$$F = (A_1 - A_3/2)P_s + (A_2 - A_3/2)P_d$$
$$= (A_1 - A_3/2)$$

Namely, the pressing force F is independent from the discharge pressure $P_d$, which largely fluctuates and depends only upon the suction pressure, which has a very small fluctuation, resulting in a smoother operation of the displacement control plate 22.

Of course, the present invention is not limited to the illustrated and above-mentioned embodiment and can be variously modified without deviating from the scope of the invention. For example, it is possible to connect the seal groove 35*a* and the annular passage 4*a*, to feed the oil of the pressure corresponding to the discharge pressure into the seal groove 35*a* through the passage 9, the annular passage 5*a*, the bottoms of the vane grooves 7, and the annular passage 4*a*.

As can be understood from the above, according to the present invention, since the oil having a pressure corresponding to the discharge pressure is fed to the sealing portion which isolates the high pressure area from the low pressure area between the displacement control plate and the associated side plate, a leakage of the refrigerant gas of the pressure corresponding to the discharge pressure in the first pressure chamber can be prevented. Furthermore, since the high pressure area defined by the sealing portion is small, the force which presses the displacement control plate toward the cylinder is reduced and the displacement control plate is not influenced by the discharge pressure which has a relatively large fluctuation, so that the operation of the displacement control plate can be smoothly and stably carried out, resulting in a precise control of the largest displacement of the compression chambers at the closure thereof in accordance with the ambient temperature.

We claim:

1. A variable displacement vane compressor comprising a housing having therein a cylinder secured thereto, a pair of side plates secured to the axial opposite ends of the cylinder, a rotor rotatably supported between the side plates and having a plurality of vanes movably supported in the rotor and coming into contact with the inner peripheral surface of the cylinder to define a plurality of compression chambers between the inner peripheral surface of the cylinder and the outer peripheral surface of the rotor, volumes of said compression chambers being changed in accordance with the rotation of the rotor, said cylinder being provided with refrigerant inlet ports and refrigerant outlet ports which can be selectively connected to the compression chambers, and a reciprocally rotatable displacement control plate located between the rotor and one of the side plates for controlling the largest displacement of the compression chambers when closed, wherein the improvement comprises a spool chamber provided in said one side plate and opposed to the displacement control plate, a spool which reciprocates in the spool chamber to define a first pressure chamber in which a refrigerant having a pressure corresponding to the discharge pressure of the compressor is introduced and a second pressure chamber in which an oil having a pressure corresponding to the discharge pressure is introduced through a control valve means in response to the suction pressure of the compressor, said spool and said displacement control plate being interconnected by a connecting member and moving together, an annular sealing means between said displacement control plate and said one side plate for isolating a high pressure area from a low pressure area of the compressor, and feed passage means for introducing the oil having a pressure corresponding to the discharge pressure into the sealing means, said one side plate being provided with an elongated hole which permits movement of said connecting member extending therethrough, the annulus of said annular sealing means having a diameter smaller than that of an imaginary circle centered on the axis of rotation of the rotor and circumscribing the elongated hole, the annulus of said annular sealing means being eccentric to the axis of rotation of the rotor and including the elongated hole in the annulus of the annular sealing portion.

2. A vane compressor according to claim 1, wherein the surface area of the displacement control plate located inside the annular sealing means is substantially half the total surface area of the displacement control plate receiving pressure from a side of the cylinder.

3. A vane compressor according to claim 1, wherein said annular sealing means comprises an annular seal groove provided in said one side plate, and a seal ring inserted in the annular seal groove.

4. A vane compressor according to claim 2, further comprising means for reducing the pressure in the second pressure chamber defined in the spool chamber.

5. A vane compressor according to claim 2, wherein said connecting member is a drive pin secured to the displacement control plate.

6. A vane compressor according to claim 1, wherein said control valve means comprises a non-return valve in the passage means and operating in response to the suction pressure.

7. A vane compressor according to claim 6, wherein said non-return valve normally opens the passage means.

8. A vane compressor according to claim 7, wherein said control valve means further comprises a piston for bringing the non-return valve to a closed position in which the passage means is closed.

9. A variable displacement vane compressor comprising a rotor rotatably supported between a pair of side plates secured to a cylinder in a housing, vanes movably supported in the rotor to define variable compression chambers in the cylinder, a reciprocally rotatable displacement control plate located between the rotor and one of the side plates for controlling the largest displacement of the compression chambers when closed, a spool chamber provided in the one side plate and opposed to the displacement control plate, a spool which reciprocates in the spool chamber to define a first pressure chamber in which a refrigerant having a discharge pressure is introduced and a second pressure chamber in which an oil having a discharge pressure is introduced through a control valve unit in response to the suction pressure, the spool and the displacement control plate being interconnected by a connecting member and moving together, a seal ring between the displacement control plate and the one side plate, for isolating a high pressure area from a low pressure area, and feed passages for introducing the oil having the discharge pressure to the sealing ring, said one side plate having an elongated hole which permits movement of the connecting member extending therethrough, said seal ring having a diameter smaller than that of an imaginary circle centered on the rotation axis of the rotor and circumscribing the elongated hole, said seal ring being eccentric to the rotation axis of the rotor and including the elongated hole in the seal ring.

* * * * *